US007984812B2

(12) United States Patent
Pike et al.

(10) Patent No.: US 7,984,812 B2
(45) Date of Patent: Jul. 26, 2011

(54) RACK SYSTEM AND SUPPORT MEMBER FOR SUPPORTING A FOLDING RACK IN A DISHWASHER

(75) Inventors: Michael Bryan Pike, Kinston, NC (US); Ronald Gene Tynes, Winterville, NC (US); John C. Bragg, Goldsboro, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 740 days.

(21) Appl. No.: 12/029,624

(22) Filed: Feb. 12, 2008

(65) Prior Publication Data

US 2008/0272073 A1 Nov. 6, 2008

Related U.S. Application Data

(60) Provisional application No. 60/916,073, filed on May 4, 2007.

(51) Int. Cl.
*A47G 19/08* (2006.01)

(52) U.S. Cl. ..... 211/41.9

(58) Field of Classification Search ..... 211/41.9, 211/41.8, 184, 183; 134/56 D, 200, 201; 312/311, 331; 248/316.7
See application file for complete search history.

(56) References Cited

U.S. PATENT DOCUMENTS

| | | | | | |
|---|---|---|---|---|---|
| 4,226,490 | A * | 10/1980 | Jenkins et al. | 312/331 |
| 4,606,464 | A * | 8/1986 | Jordan et al. | 211/41.8 |
| 4,917,248 | A * | 4/1990 | Friskney | 211/41.8 |
| 4,927,033 | A * | 5/1990 | Patera et al. | 211/41.9 |
| 5,158,185 | A * | 10/1992 | Michael et al. | 211/41.8 |
| 5,351,837 | A * | 10/1994 | Smith | 211/41.8 |
| 5,918,749 | A * | 7/1999 | Pille et al. | 211/41.9 |
| 6,546,942 | B2 * | 4/2003 | Smith et al. | 134/201 |
| 6,827,225 | B2 * | 12/2004 | Miilu et al. | 211/41.9 |
| 6,848,585 | B2 * | 2/2005 | VanLandingham | 211/41.9 |
| 7,168,578 | B2 * | 1/2007 | Mersch et al. | 211/41.8 |
| 7,543,712 | B2 * | 6/2009 | Purushothaman | 211/41.9 |
| 7,682,465 | B2 * | 3/2010 | Anderson et al. | 134/56 D |
| 7,766,175 | B2 * | 8/2010 | Jadhav et al. | 211/41.9 |
| 2003/0089672 | A1 * | 5/2003 | VanLandingham | 211/41.8 |
| 2004/0108283 | A1 * | 6/2004 | Miilu et al. | 211/41.9 |
| 2006/0213844 | A1 * | 9/2006 | Purushothaman | 211/41.9 |
| 2008/0083678 | A1 * | 4/2008 | Graute | 211/41.8 |
| 2008/0272073 | A1 * | 11/2008 | Pike et al. | 211/41.9 |
| 2008/0302740 | A1 * | 12/2008 | Moser et al. | 211/41.8 |
| 2010/0116759 | A1 * | 5/2010 | Lindgren et al. | 211/41.8 |

FOREIGN PATENT DOCUMENTS

| | | |
|---|---|---|
| DE | 31 35 458 A1 | 3/1983 |
| WO | WO-00/49935 | 8/2000 |

* cited by examiner

*Primary Examiner* — Sarah Purol
(74) *Attorney, Agent, or Firm* — Alston & Bird LLP

(57) ABSTRACT

A support member is provided that includes a body defining a first channel configured to engage a main spine of a folding rack and a second channel perpendicularly disposed with respect to the first channel and configured to engage a wire member of a dishwasher rack so as to secure the folding rack thereto. The body further defines an aperture configured to receive therethrough one of a plurality of tines of the folding rack. The aperture can define horizontal and vertical support portions configured to support the tine when the folding rack is in folded and unfolded positions, respectively. The aperture can further define an arcuate channel extending between the horizontal support portion and the vertical support portion, the arcuate channel being configured to axially displace the tine along the longitudinal axis as the tine is moved between the horizontal support portion and the vertical support portion.

22 Claims, 2 Drawing Sheets

RACK SYSTEM AND SUPPORT MEMBER FOR SUPPORTING A FOLDING RACK IN A DISHWASHER

CROSS-REFERENCE TO A RELATED APPLICATION

The present application claims priority to U.S. Provisional Patent Application No. 60/916,073 filed on May 4, 2007, which is incorporated herein by reference in its entirety.

FIELD OF THE INVENTION

Various embodiments of the present invention are directed to a rack system and support member for supporting a folding rack in a washing appliance, such as a dishwasher.

BACKGROUND OF THE INVENTION

Conventional dishwashers typically include one or more wire racks for holding, for example, dishware, glassware, or cookware. In order to facilitate the loading and retention of the items to be washed in the dishwasher, each rack may include one or more tines extending generally vertically upward from the rack. For example, where such tines are provided in an upper rack of the dishwasher, the tines may be used to support cups, glasses, or other similar items. However, in some instances, it may be desirable to fold the tines, to a position where the tines are substantially flush with the rack, so as to accommodate other items (i.e., a baking pan) which may not necessarily need the support of the tines.

The tines may be provided in rows, wherein each row of tines is formed as a single piece unit with the tines extending from a main spine. Furthermore, in some such rack configurations, two rows of such tines may be configured to rotate about the axis of each spine so as to fold toward each other. However in conventional dishwashers the tines extending from adjacent main spines may be regularly spaced along each main spine so that the two rows of tines can cooperate to support a single item, such as a plate. Therefore, the tines extending from such adjacent and rotatable (i.e. foldable) main spines may interfere with each other when the two rows are folded to be substantially flush with the rack.

Thus, there exists a need for an apparatus that allows adjacent rows of tines to be aligned with each other when in an unfolded position, but which also do not interfere with each other when the rows of tines are folded to be substantially flush with the rack. There further exists a need for such an apparatus that can be implemented with existing dishwasher racks with relatively low-cost and easily-installed components.

BRIEF SUMMARY OF THE INVENTION

In one aspect, a dishwasher rack system is provided. The dishwasher rack system includes a dishwasher rack having a wire member and a folding rack having a main spine extending along a longitudinal axis perpendicularly to the wire member of the dishwasher rack and a plurality of tines spaced apart and extending perpendicularly from the main spine. The dishwasher rack system also includes a support member operably engaged between the dishwasher rack and the folding rack. The support member defines a first channel configured to engage the main spine of the folding rack, such that the main spine is rotatable with respect to the first channel about the longitudinal axis such that the folding rack is movable between a folded position and an unfolded position with respect to a dishwasher rack. The support member also defines a second channel perpendicularly disposed with respect to the first channel and configured to engage a wire member of the dishwasher rack so as to secure the folding rack thereto. In some cases, the first channel can be configured to engage a second wire member. The support member further defines an aperture configured to receive one of the plurality of tines of the folding rack therethrough. The aperture defines a horizontal and a vertical support portion configured to support the tine when the folding rack is in the folded and unfolded positions, respectively. The aperture also defines an arcuate channel extending between the horizontal support portion and the vertical support portion, the arcuate channel being configured to axially displace the tine along the longitudinal axis as the tine is moved between the horizontal support portion and the vertical support portion.

In some embodiments, the support member can be formed from an injection-molded polymer, or can be machined from a polymer blank. In other embodiments, the support member may include one or more resilient projections defining the second channel for engaging the wire member of the dishwasher rack so as to secure the folding rack thereto. In still other embodiments, the plurality of tines can include a curved section, for example, as where the plurality of tines includes a first straight section extending from the spine, a curved section extending from the first straight section, and a second straight section extending from the curved section. In yet other embodiments, the plurality of tines can rotate approximately 90 degrees when the folding rack is moved from the folded position to the unfolded position.

In some embodiments, the dishwasher rack system may further include a second folding rack comprising a second plurality of tines and a second main spine. Individual tines of the second plurality of tines can be substantially straight. Individual tines of the plurality of tines can have corresponding tines on the second plurality of tines. The plurality of tines can be axially offset from the second plurality of tines when the folding rack is in the folded position but not axially offset from the second plurality of tines when the folding rack is in the unfolded position. A second support member can be operably engaged between the dishwasher rack and the second folding rack, the support member causing the folding rack to be displaced a first distance in a first direction and the second support member causing the second folding rack to be displaced a second distance in a second direction, either the first distance being not equal to the second distance or the first direction being different from the second direction. The second plurality of tines can maintain an axial disposition when the second folding rack is folded so as not to be axially displaced upon folding of the second folding rack.

In another aspect, a support member is provided for operably engaging a folding rack of a dishwasher, where the folding rack is movable between a folded position and an unfolded position with respect to a dishwasher rack and having a main spine extending along a longitudinal axis and a plurality of tines spaced apart and extending perpendicularly from the main spine. The support member includes a body defining a first channel configured to engage the main spine of the folding rack, such that the main spine is rotatable with respect to the first channel about the longitudinal axis, and a second channel perpendicularly disposed with respect to the first channel and configured to engage a wire member of the dishwasher rack so as to secure the folding rack thereto. The body further defines an aperture configured to receive therethrough one of the plurality of tines of the folding rack. The aperture can define a horizontal support portion configured to support the one of the plurality of tines when the folding rack is in the folded position and a vertical support portion configured to support and secure the tine when the folding rack is in the unfolded position. The aperture can further define an arcuate channel extending between the horizontal support portion and the vertical support portion, the arcuate channel being configured to axially displace the tine along the longitudinal axis as the tine is moved between the horizontal support portion and the vertical support portion.

In some embodiments, the body may include one or more resilient projections defining the second channel for engaging the wire member of the dishwasher rack so as to secure the folding rack thereto. In other embodiments, the aperture can be configured to receive therethrough one of a plurality of tines comprising a curved section. In still other embodiments, the aperture can be configured to receive therethrough one of a plurality of tines that rotates approximately 90 degrees when the folding rack is moved from the folded position to the unfolded position.

Thus, the various embodiments of the present invention provide many advantages that may include, but are not limited to: providing a clip member for operably engaging a folding rack with a wire member of a dishwasher rack such that the tines of adjacent folding racks may be axially adjustable relative to one another when the folding racks are disposed in a folded position relative to the dishwasher rack; providing a dishwasher rack system employing a low-cost polymeric clip that is capable of axially adjusting a position of a folding rack as the folding rack is moved to a folded position relative to a dishwasher rack; and providing a relatively simple mechanical clip member for a folding rack that may be easily manufactured via injection molding or other high-volume manufacturing processes while still providing for the axial adjustment of the folding rack.

These and other advantages are provided by various embodiments of the present invention.

BRIEF DESCRIPTION OF THE SEVERAL VIEWS OF THE DRAWINGS

Figure 1:
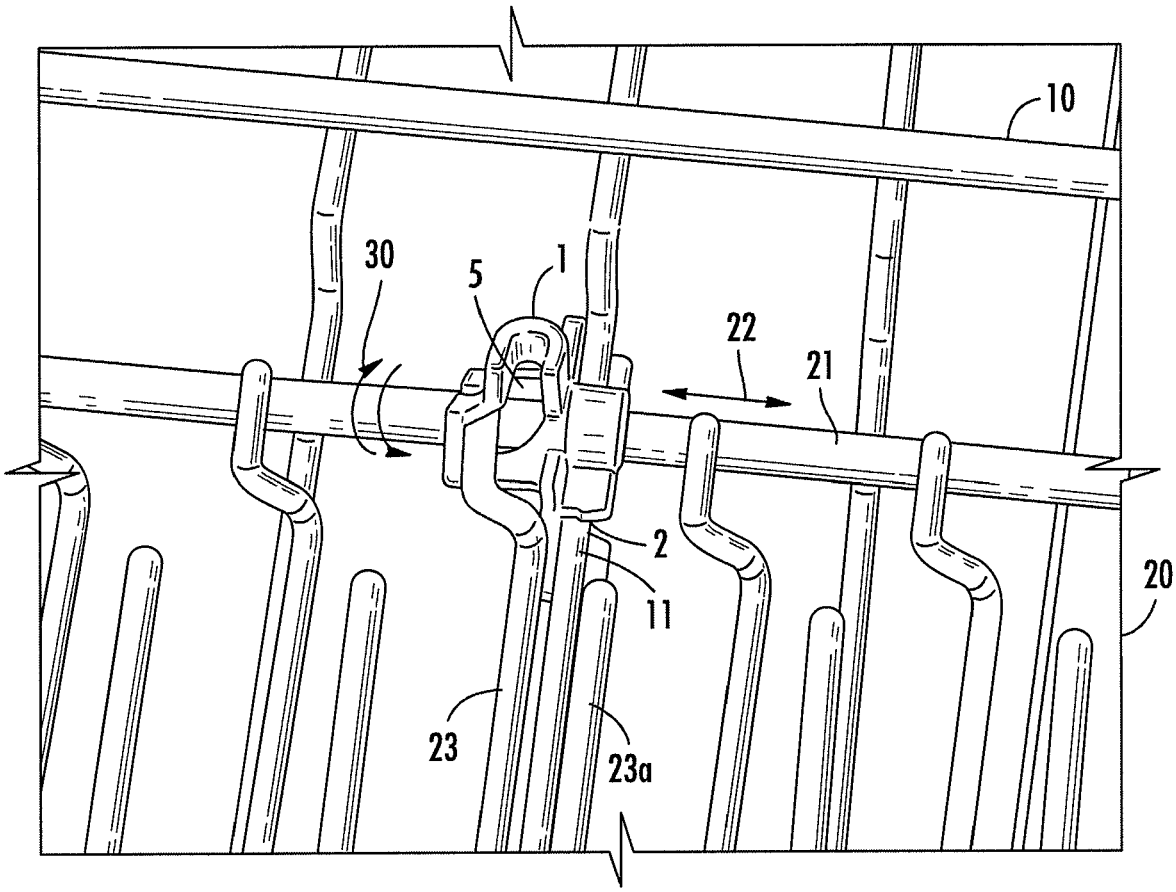
Figure 2:
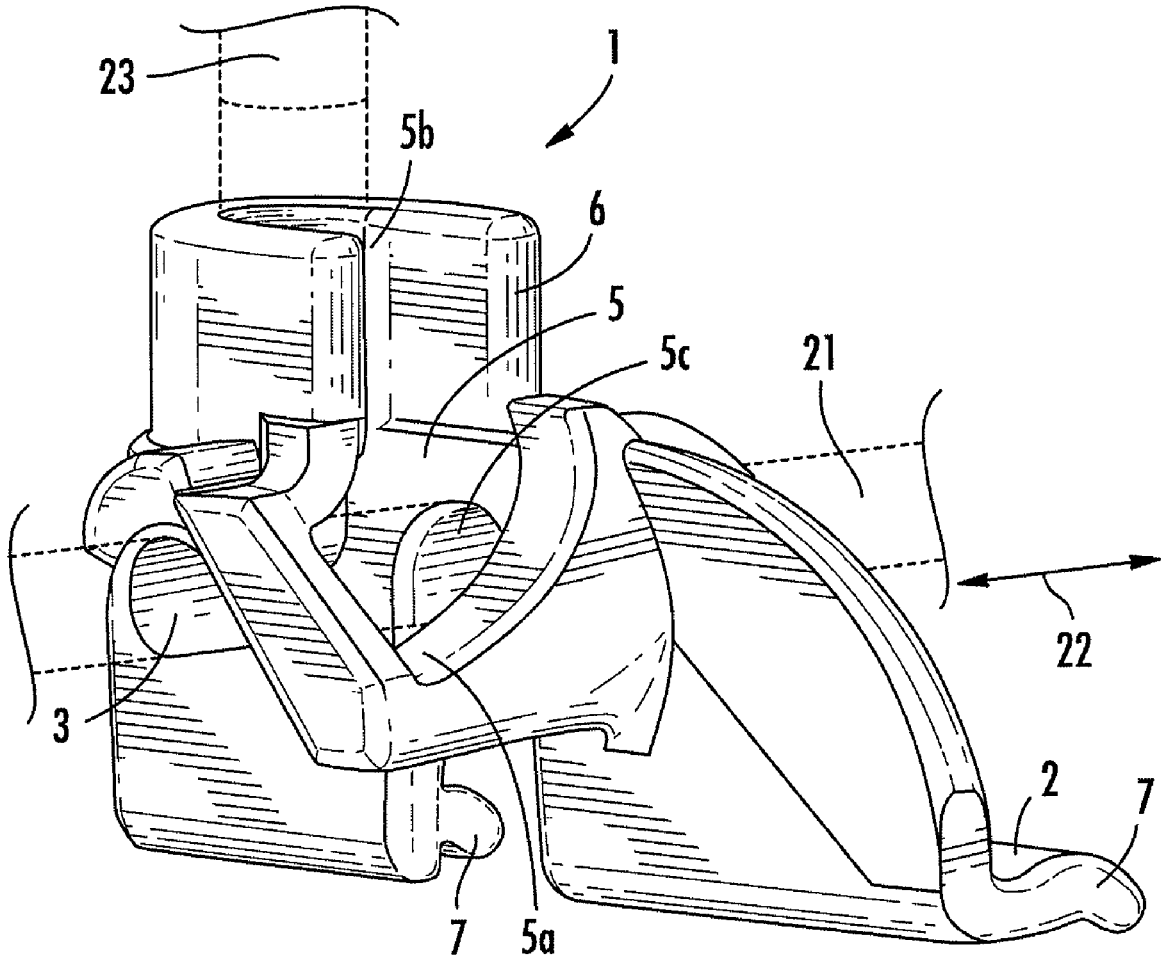

Having thus described various embodiments of the invention in general terms, reference will now be made to the accompanying drawings, which are not necessarily drawn to scale, and wherein:

FIG. 1 is a non-limiting photograph of an exemplary clip member operably engaged between a folding rack and a dishwasher rack, according to one embodiment of the present invention; and FIG. 2 is a non-limiting perspective view of an exemplary clip member, according to one embodiment of the present invention, comprising a body defining apertures for receiving a main spine of a folding rack, a wire member of a dishwasher rack, and a rotatable tine extending outward from the main spine of the folding rack.

DETAILED DESCRIPTION OF VARIOUS EMBODIMENTS OF THE INVENTION

Various embodiments of present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

As shown generally in FIG. 1, some embodiments of the present invention provide a support member, such as clip member 1, adapted for operably engaging a folding rack 20 of a dishwasher. The folding rack 20 may include a main spine 21 extending along a longitudinal axis 22 and a plurality of tines 23 spaced apart and extending perpendicularly from the main spine 21. As shown generally in FIGS. 1 and 2 the clip member 1 may comprise a body defining a first channel 3 adapted to engage the main spine 21 of the folding rack 20, such that the main spine 21 is rotatable (see element 30, FIG. 1, for example) with respect to the first channel 3 about the longitudinal axis 22 such that the folding rack 20 is movable between a folded position (see generally, FIG. 1) and an unfolded position (see generally, FIG. 2, showing a tine 23 disposed in the vertical support portion 5*b* of the aperture 5 defined in the body of the clip member 1) with respect to a dishwasher rack 10.

As shown generally in FIG. 2, the body of the clip member 1 further defines a second channel 2 perpendicularly disposed with respect to the first channel 3 and adapted to engage a wire member 11 of the dishwasher rack 10 so as to rotatably secure the folding rack 20 to the dishwasher rack 10 (as shown in FIG. 1). In some embodiments, the body of the clip member 1 may comprise one or more resilient projections 7 defining the second channel 2 for engaging the wire member 11 of the dishwasher rack 10 so as to secure the folding rack 20 thereto. In the illustrated embodiment, the first channel 3 has a height that receives both the main spine 21 of the folding rack 20 and a parallel underlying wire member 11 of the main dishwasher rack 10. However, the clip member 1 does not need to be clipped to a dishwasher rack 10 at the intersection of two wire members 11, and the second channel 2 can secure the clip member to the dishwasher rack by way of a single crossing wire member or other supporting feature of the dishwasher rack.

Referring again to FIG. 1, the body of the clip member 1 further defines an aperture 5 adapted to receive one of the plurality of tines 23 of the folding rack 20 therethrough. As shown in FIG. 2, the aperture 5 may be defined by a horizontal support portion 5*a* for supporting the tine 23 when the folding rack 20 is in the folded position (see FIG. 1) with respect to the dishwasher rack 10. Furthermore, the aperture 5 may further be defined by a vertical support portion 5*b* for supporting and securing the tine 23 when the folding rack 20 is in the unfolded position (i.e. wherein the tines 23 thereof extend vertically upward from the dishwasher rack 10) with respect to the dishwasher rack 10. As shown in FIG. 2, the vertical support portion 5*b* may be further defined by one or more substantially resilient projections 6 configured to extend substantially about an outer surface of the tine 23 when the tine 23 is disposed in the vertical support portion 5*b* so as to secure the tine 23 when the folding rack 20 is in the unfolded position with respect to the dishwasher rack 10.

The aperture 5 may also be defined by an arcuate channel 5*c* extending between the horizontal support portion 5*a* and the vertical support portion 5*b*. As shown generally in FIG. 1, the arcuate channel 5*c* may be adapted to accommodate axial displacement of the tine 23 along the longitudinal axis 22 as the tine 23 is moved between the horizontal support portion 5*a* and the vertical support portion 5*b*. Thus, as shown in FIG. 1, when the tine 23 is disposed in the horizontal support portion 5*a* (i.e. when the folding rack 20 is in the folded position relative to the dishwasher rack 10), the tine 23 may be axially offset from a corresponding tine 23*a* extending from a main spine of an adjacent folding rack. In some embodiments, as shown generally in FIG. 2, the arcuate channel 5*c* may be defined by a sliding surface disposed on a body of the clip member 1 such that the tine 23 may be smoothly and/or gradually urged along the longitudinal axis 22 as the tine 23 is moved from the vertical support portion 5*b* to the horizontal support portion 5*a* (and vice-versa). It should be noted that the sliding surface need not be part of closed arcuate channel 5*c* as illustrated, and any type of cam surface could be used to effect the desired axial translation of the folding rack 20.

In various embodiments, the clip member 1 (and the various channels 2, 3 and apertures 5 defined therein) may be formed using a corresponding variety of manufacturing techniques. For example, in some embodiments, the body of the clip member 1 may be formed from an injection-molded polymer. In other exemplary embodiments, the body of the clip member 1 may be machined from a polymer blank.

Some additional embodiments of the present invention may further comprise a complete dishwasher rack system (see generally, FIG. 1) comprising a dishwasher rack 10 comprising a wire member 11. The rack system may also comprise a folding rack 20 comprising a main spine 21 extending along a longitudinal axis 22 perpendicularly to the wire member 11 of the dishwasher rack 10, and a plurality of tines 23 spaced apart and extending perpendicularly from the main spine 21. Furthermore, as shown in FIG. 1, such rack system embodiments of the present invention may comprise a clip member 1 (such as that described herein with respect to FIG. 2) operably engaged between the dishwasher rack 10 and the folding rack 20. Furthermore, as described herein, the body of such a clip member 1 may comprise an aperture 5 defining an arcuate channel 5*c* configured to receive at least one of the tines 23 of the folding rack 3. As described herein, the arcuate channel 5*c* may be defined by a sliding surface disposed on the clip member 1 that is configured for axially displacing the tine 23 along the longitudinal axis 22 as the tine 23 is moved back and forth between the horizontal support portion 5*a* and the vertical support portion 5*b* of the tine aperture 5.

Furthermore, the clip member 1 of the dishwasher rack system shown generally in FIG. 1 may be configured to axially displace the tine 23 along the longitudinal axis 22 as the tine 23 is moved back and forth between the horizontal support portion 5*a* and the vertical support portion 5*b* of the tine aperture 5, such that when the tine 23 is disposed in the horizontal support portion 5*a*, the tine 23 may be axially offset from a corresponding tine 23*a* extending outward from an adjacent folding rack. Furthermore, according to various dishwasher rack system embodiments, one or more clip members 1 may be operably engaged between the dishwasher rack 10 (and/or wire members 11 thereof) and one or more folding racks 20 such that adjacent tines 23, 23*a* extending from corresponding adjacent folding racks 20 do not substantially interfere with one another when the adjacent folding racks 20 are disposed in a "flat" and/or folded position relative to the dishwasher rack 10.

The dishwasher rack system can include two folding racks 20 as noted above. If these racks 20 are spaced far enough apart and their respective tines 23 are aligned, then the racks cooperate to support large flat objects, such as dishes. However, to accommodate large objects, the two folding racks 20 may need to be spaced far enough apart that they could not fold away from each other without striking a rim wire defining the upper edge of the dishwasher rack 10. Thus, the embodiments described herein provide a rack system having two spaced but aligned folding racks 20 that can be folded towards each other without inteference. One of the folding racks 20 may be provided with a clip member 1 as described above while the other folding rack uses a conventional folding mechanism, or both of the folding racks 20 may be provided with clip members 1 provided the clip members do not move the folding racks in the same axial direction by the same axial distance.

Many modifications and other embodiments of the inventions set forth herein will come to mind to one skilled in the art to which these inventions pertain having the benefit of the teachings presented in the foregoing descriptions and the associated drawings. For example, while the embodiments discussed above have generally represented the support member as a clip member, other types of support members are also possible, including a support member formed as an integral part of or otherwise attached to one of the folding racks 20 or the dishwasher rack 10. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A support member for operably engaging a folding rack of a dishwasher, the folding rack being movable between a folded position and an unfolded position with respect to a dishwasher rack and having a main spine extending along a longitudinal axis and a plurality of tines spaced apart and extending perpendicularly from the main spine, the support member comprising:

a body defining a first channel configured to engage the main spine of the folding rack, such that the main spine is rotatable with respect to the first channel about the longitudinal axis, a second channel perpendicularly disposed with respect to the first channel and configured to engage a wire member of the dishwasher rack so as to secure the folding rack thereto, and an aperture configured to receive therethrough one of the plurality of tines of the folding rack, the aperture defined by a horizontal support portion configured to support the one of the plurality of tines when the folding rack is in the folded position, and a vertical support portion configured to support and secure the one of the plurality of tines when the folding rack is in the unfolded position, wherein the aperture is further configured to accommodate axial displacement of the one of the plurality of tines along the longitudinal axis as the one of the plurality of tines is moved between the horizontal support portion and the vertical support portion.

2. A support member according to claim 1, wherein the body is formed from an injection-molded polymer.

3. A support member according to claim 1, wherein the body is machined from a polymer blank.

4. A support member according to claim 1, wherein the body comprises one or more resilient projections defining the second channel for engaging the wire member of the dishwasher rack so as to secure the folding rack thereto.

5. A support member according to claim 1, wherein the aperture is configured to receive therethrough one of a plurality of tines comprising a curved section.

6. A support member according to claim 5, wherein the aperture is configured to receive therethrough one of a plurality of tines comprising a first straight section extending from the spine, the curved section extending from the first straight section, and a second straight section extending from the curved section.

7. A support member according to claim 1, wherein the aperture is configured to receive therethrough one of a plurality of tines that rotates approximately 90 degrees when the folding rack is moved from the folded position to the unfolded position.

8. A support member according to claim 1, wherein the first channel is configured to engage a second wire member.

9. A dishwasher rack system comprising:

a dishwasher rack comprising a wire member;

a folding rack comprising a main spine extending along a longitudinal axis perpendicularly to the wire member of the dishwasher rack and a plurality of tines spaced apart and extending perpendicularly from the main spine; and a support member operably engaged between the dishwasher rack and the folding rack, the support member defining a first channel configured to engage the main spine of the folding rack, such that the main spine is rotatable with respect to the first channel about the longitudinal axis such that the folding rack is movable between a folded position and an unfolded position with respect to a dishwasher rack, wherein the support member further defines a second channel perpendicularly disposed with respect to the first channel and configured to engage a wire member of the dishwasher rack so as to secure the folding rack thereto, wherein the support member further defines an aperture configured to receive one of the plurality of tines of the folding rack therethrough, the aperture defined by a horizontal support portion configured to support the one of the plurality of tines when the folding rack is in the folded position, and a vertical support portion configured to support and secure the one of the plurality of tines when the folding rack is in the unfolded position, wherein the aperture is further configured to accommodate axial displacement of the one of the plurality of tines along the longitudinal axis as the one of the plurality of tines is moved between the horizontal support portion and the vertical support portion.

10. A dishwasher rack system according to claim 9, wherein the support member is formed from an injection-molded polymer.

11. A dishwasher rack system according to claim 9, wherein the support member is machined from a polymer blank.

12. A dishwasher rack system according to claim 9, wherein the support member comprises one or more resilient projections defining the second channel for engaging the wire member of the dishwasher rack so as to secure the folding rack thereto.

13. A dishwasher rack system according to claim 9, wherein the plurality of tines comprises a curved section.

14. A dishwasher rack system according to claim 13, wherein the plurality of tines comprises a first straight section extending from the spine, the curved section extending from the first straight section, and a second straight section extending from the curved section.

15. A dishwasher rack system according to claim 9, wherein the plurality of tines rotates approximately 90 degrees when the folding rack is moved from the folded position to the unfolded position.

16. A dishwasher rack system according to claim 9, wherein the first channel is configured to engage a second wire member.

17. A dishwasher rack system according to claim 9, further comprising:

a second folding rack comprising a second plurality of tines and a second main spine;

wherein individual tines of the plurality of tines have corresponding tines on the second plurality of tines;

wherein the plurality of tines are axially offset from the second plurality of tines when the folding rack is in the folded position; and wherein the plurality of tines are not axially offset from the second plurality of tines when the folding rack is in the unfolded position.

18. A dishwasher rack system according to claim 17, further comprising:

a second support member operably engaged between the dishwasher rack and the second folding rack;

wherein the support member causes the folding rack to be displaced a first distance in a first direction;

wherein the second support member causes the second folding rack to be displaced a second distance in a second direction; and wherein either the first distance is unequal to the second distance or the first direction is different from the second direction.

19. A dishwasher rack system according to claim 17, wherein the second plurality of tines maintains an axial disposition when the second folding rack is folded.

20. A dishwasher rack system according to claim 19, wherein individual tines of the second plurality of tines are substantially straight.

21. A support member according to claim 1, wherein the aperture is further defined by an arcuate channel extending between the horizontal support portion and the vertical support portion, and wherein the arcuate channel is configured to accommodate axial displacement of the one of the plurality of tines along the longitudinal axis as the one of the plurality of tines is moved between the horizontal support portion and the vertical support portion.

22. A dishwasher rack system according to claim 9, wherein the aperture is further defined by an arcuate channel extending between the horizontal support portion and the vertical support portion, and wherein the arcuate channel is configured to accommodate axial displacement of the one of the plurality of tines along the longitudinal axis as the one of the plurality of tines is moved between the horizontal support portion and the vertical support portion.

* * * * *